United States Patent [19]

Feld

[11] Patent Number: 5,040,155

[45] Date of Patent: Aug. 13, 1991

[54] DOUBLE GUIDED MUD PULSE VALVE

[75] Inventor: Dagobert Feld, Hanover, Fed. Rep. of Germany

[73] Assignee: Baker Hughes Incorporated, Houston, Tex.

[21] Appl. No.: 564,884

[22] Filed: Aug. 9, 1990

[30] Foreign Application Priority Data

Aug. 16, 1989 [DE] Fed. Rep. of Germany ..... 3926908

[51] Int. Cl.[5] ..... G01V 1/40

[52] U.S. Cl. ..... 367/85

[58] Field of Search ..... 367/83, 85

[56] References Cited

U.S. PATENT DOCUMENTS

| | | | |
|---|---|---|---|
| 3,958,217 | 5/1976 | Spinnler | 340/18 |
| 4,641,289 | 3/1987 | Jurgens | 367/85 |
| 4,742,498 | 5/1988 | Barron | 367/85 |
| 4,802,150 | 1/1989 | Russell et al. | 367/85 |
| 4,901,290 | 2/1990 | Feld et al. | 367/85 |
| 4,905,778 | 3/1990 | Jurgens | 175/232 |

FOREIGN PATENT DOCUMENTS

| | | |
|---|---|---|
| 2941102 | 10/1979 | Fed. Rep. of Germany . |
| 3102238 | 1/1981 | Fed. Rep. of Germany . |

*Primary Examiner*—Ian J. Lobo

*Attorney, Agent, or Firm*—Michael Polacek

[57] ABSTRACT

The present invention discloses a double guided slide valve apparatus for producing pressure pulses in drilling mud medium flowing through a drill string casing.

15 Claims, 1 Drawing Sheet

DOUBLE GUIDED MUD PULSE VALVE

BACKGROUND OF THE INVENTION

The present invention discloses a novel device for producing pressure pulses in drilling mud medium flowing through a drill string casing. More particularly, a balanced, double guided mud pulse valve is disclosed herein.

With known devices of this type, see, e.g., U.S. Pat. No. 3,958,217 or U.S. Pat. No. 4,901,290, the main valve body is supported by the carrying body at the main valve's rear end into the direction of mud flow so that the valve's body can move axially. The main valve body also includes a tube projection on its front end facing the flow. This projection has a diameter smaller than the diameter of a narrow passage in the casing and extends through the narrow passage against the direction of the mud flow. The projection also includes side slits which form inlet openings for an internal flow channel. The present invention discloses an especially simple low wear and reliable device of the aforementioned type.

SUMMARY OF THE INVENTION

The present invention discloses the placement of the tube projection on the carrying body itself thereby making the pressure sampling in front of the narrow passage in the casing independent of the position and movement of the main valve body and therefore free of the fluctuations resulting therefrom. At the same time, the design of the main valve body is therefore simplified, the valve is subject to less wear, and the system offers greater response sensitivity.

Furthermore, the double guidance of the main valve body counteracts any tilting movements and the resulting jamming effects so that the present device can also be used reliably with sandy drilling mud media and in drill casings for directional drilling, especially horizontal drilling. With the possibility of guiding a cable and establishing a mechanical and/or electrical connection with the upper end of the present device within the casing, the main part of the device can also be designed as a retractable structural unit.

DESCRIPTION OF THE PREFERRED EMBODIMENT

Figure 1:
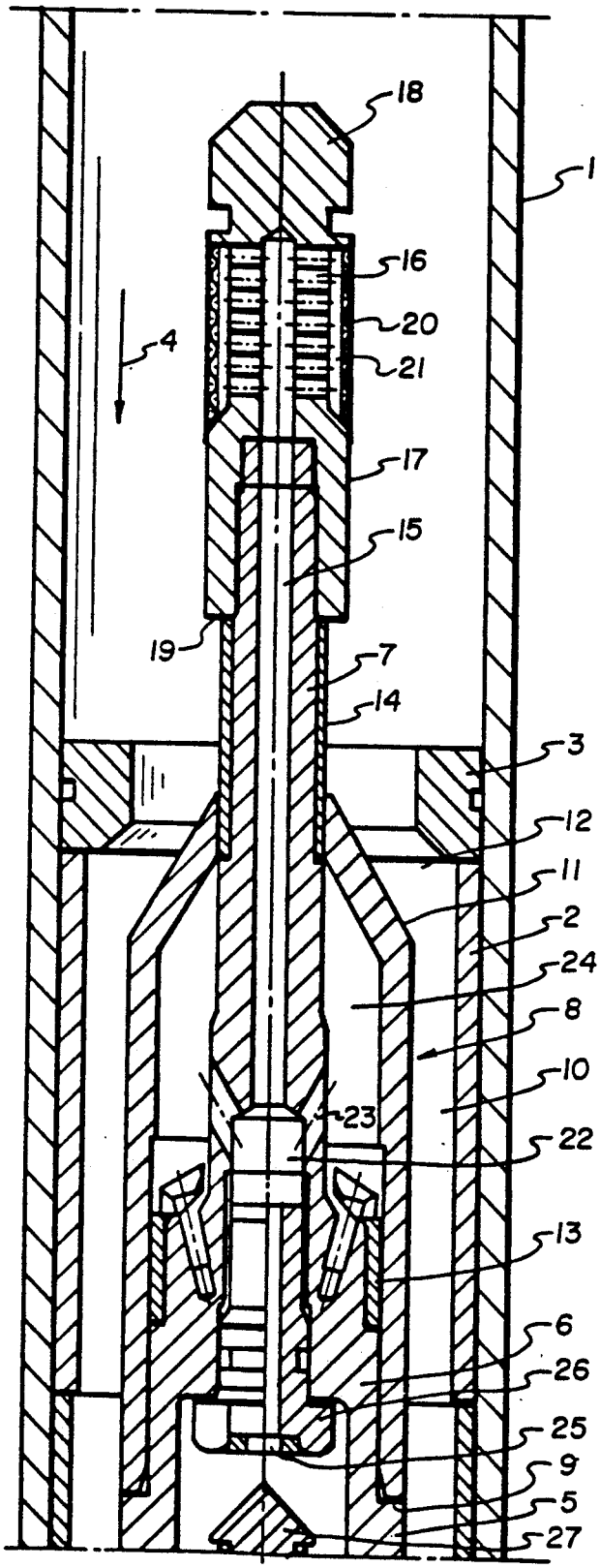
FIG. 1 is a cut-away longitudinal sectional view of a valve apparatus disclosed by the present invention.

The present invention will now be described in greater detail and with reference to the accompanying drawing. With reference now to FIG. 1, the device illustrated therein for producing pressure pulses in drilling mud medium flowing through a drill string casing 1 comprises a tubular casing 2 that is supported in a stationary position within drill string casing 1 and includes a narrow passage formed by a separate ring-shaped body 3 placed on the front end, as seen in the direction of flow 4, of casing 2.

A tubular shaped supporting body 5 is supported in a stationary position inside casing 2 and includes a base part 6 as well as a tube projection 7 which has a diameter which is less than the diameter of the narrow passage body 3 of casing 2 and which is advanced through the narrow passage body 3 against the direction of flow 4 into the high pressure region of the drilling mud stream.

A tubular main valve body 8 is supported by supporting body 5, and, like supporting body 5, it is also arranged coaxially within casing 2 and can move axially from its starting position, as shown in FIG. 1 and defined by shoulder 9 being in contact with supporting body 5, against the direction of flow 4 of the drilling mud medium stream into an upper operating position (not shown). The outer surface of main valve body 8 defines the inner border of an outer flow channel 10 for drilling mud medium between the main valve body 8 and the casing 2, and, between its tapered front end 11 and the narrow passage body 3, it defines a throttle zone 12 with a flow cross section that varies as a function of the position of the main valve body 8.

The supporting body 5 further includes a first slide guide 13 at its base part 6 so that the rear end of the main valve body 8 is supported on the first slide guide 13. This slide guide 13 is preferably provided with a hard coating, e.g., a separate sleeve of tungsten carbide, which acts as a reinforcement against wear. This is especially important when working with drilling mud media containing abrasive particles such as sand.

The front end 11 of main valve body 8, which tapers in a direction opposite to the direction of flow 4, is supported and guided on tube projection 7 by a second slide guide 14 which may also include a hard metal sleeve or some other reinforcing hard metal coating. Due to this double guidance of the main valve body 8, wherein the guide elements may be made completely of a hard metal, e.g., tungsten carbide, the jamming of the main valve body 8 resulting from the tilting movements of the drill string can be effectively prevented. This is so even if the device is used in a horizontal drill casing, for which purpose the device disclosed herein is especially suitable.

The connecting placement of the tube projection 7 to the supporting body 5 permits a great simplification of the design of the main valve body 8. As a result of this simplification, the main valve body 8 can offer a lower moment of inertia and thus can react with greater sensitivity to the differences in pressure acting on it. In particular, however, this simplified design reduces wear on the main valve body 8 during its operation, especially with respect to drilling mud media containing abrasive particles such as sand.

The supporting body 5 includes a coaxial and continuous internal flow channel 15 whose inlet opening, consisting of a number of radially aligned boreholes 16, is arranged centrally and in front of, with respect to the direction of flow 4, narrow passage body 3 in casing 2. These boreholes 16 are provided in an attachment part 17 on the end of tube projection 7 where the upper end of part 17 is designed as a coupling pin 18 for a pulling tool (not shown . The attachment part 17 has a rear end 19 that forms a safety stop for main valve body 8 and prevents the main valve body 8 from sliding away from supporting body 5 against the direction of flow 4. Such a movement cannot otherwise be completely ruled out when the drill casing 1 is horizontally aligned or under certain pressure conditions and whenever the inside diameter of ring body 3 is larger than the outside diameter of main valve body 8.

To reduce the danger of blockage, a screen 20 is placed in front of the boreholes 16 that define the inlet opening for the internal flow channel 15. The outside area of screen 20 is aligned coaxially with and is flush with the outside surface of the attachment part 17. The outside surface of screen 20 therefore has drilling mud medium flowing parallel to it over its full axial length so that the screen is exposed to a constant self-cleaning effect. This is especially important when the drilling mud medium is mixed with thickener additives. Behind screen 20, there is an annular space 21 into which boreholes 16 open so that all the boreholes 16 are open for operation even when screen 20 is temporarily partially blocked.

The internal flow channel 15 includes an enlargement 22 within the base part 6 of supporting body 5. This enlargement 22 is connected by connecting channels 23 to pressure chamber 24 which is positioned between the tube projection 7 of supporting body 5 and the inner surface of main valve body 8. Accordingly, a pressure that corresponds to the pressure in the drilling mud medium in the internal flow channel 15 at the level of the branch for connecting channels 23 prevails within pressure chamber 24.

At the base part 6 of supporting body 5, the internal flow channel 15 also includes an outlet opening in the form of a valve opening 25 within a valve seat 26 which is screwed into the enlargement 22 of the internal flow channel 15. This valve opening 25 can be sealed by means of valve body 27 which can be moved from its open position, shown here, into a closed position (not shown) by means of a drive which is not shown here but may consist of, for example, an electromagnet. Parts 26 and 27 form an auxiliary valve by means of which flow of drilling mud medium through the internal flow channel 15 can be released or blocked.

This auxiliary valve is controlled by a device (not shown) for determining drilling measurement data. This device is located downstream from supporting body 5 and the pressure pulses initiated by the auxiliary valve in the drilling mud medium are received by a pressure sensor above ground and relayed to an analyzer. For a more detailed explanation of this system, reference can be made to the discussion and explanation thereof in U.S. Pat. No. 4,901,290.

To produce a pressure pulse in a drilling medium, the auxiliary valve is closed by the measurement device. Accordingly, a pressure builds up in the internal flow channel 15 and thus also within pressure chamber 24. This pressure corresponds to the pressure of the drilling medium at the area of the inlet opening to internal flow channel 15. This prevailing pressure in pressure chamber 24 exerts hydraulic forces on main valve body 8 in the direction opposite to the direction of flow 4. The sum of these hydraulic forces on main valve body 8 exceeds the sum of the forces acting in the direction of flow 4 when the main valve body 8 is in the starting position as shown in FIG. 1. The hydraulic forces acting axially in the direction of flow 4 on main valve body 8 are comprised of static and dynamic forces derived from the pressure and flow conditions in outer flow channel 10 and throttle zone 12.

Immediately after the auxiliary valve is closed, the main valve body 8 moves in the direction opposite the direction of flow 4 with an acceleration that results from the prevailing difference in axial forces. Due to this movement, the hydraulic forces acting on main valve body 8 in the direction of flow 4 undergo a change because the flow cross section and flow conditions in throttle zone 12 change due to the approach of main valve body 8 towards the narrow passage body 3.

In the example shown here, as in the case of the valve disclosed in U.S. Pat. No. 4,901,290, the hydraulically effective dimensions are coordinated in such a way that the total resultant of all forces acting on main valve body 8 against the direction of flow 4 at the time when the main valve body 8 begins to move out of its starting position after the closing of the auxiliary valve is at first relatively small, then becomes larger with an increase in stroke length, and finally decreases again until it reaches a value of zero. In the position (not shown) where the total resultant of all forces acting on the main valve body 8 has a value of zero, the main valve body 8 assumes its pressure pulse generating end position in which the main valve body 8 is suspended in the drilling medium without the help of a stop.

After the auxiliary valve is opened, the pressure in the pressure chamber 24 again assumes a value at which the sum of the forces acting in the direction of flow 4 on the main valve body 8 exceeds the sum of forces acting opposite the direction of flow 4 with the result that the main valve body 8 returns to its starting position as shown in FIG. 1 and is ready for another pressure pulse generating operating cycle.

While the present invention has been described herein with reference to a specific exemplary embodiment thereof, it will be evident that various modifications and changes may be made thereto without departing from the broader spirit and scope of the invention as set forth in the appended claims. The specification and drawing included herein are, accordingly to be regarded in an illustrative rather than in a restrictive sense.

What is claimed is:

1. Apparatus for generating pressure pulses in drilling mud medium flowing through a drill string casing comprising:

a tubular casing including a narrow passage therewithin proximate to said tubular casing and a tubular main valve body arranged coaxially in said tubular casing thereby forming an outer flow channel wherein said valve body can move axially from a starting position in a direction opposite to the direction of mud flow into an operating position within said narrow passage so that the flow cross section of the outer flow channel varies as a function of the position of the main valve body with respect to said narrow passage;

a tubular supporting body arranged coaxially within said main valve body and including a first slide guide for the down stream end of said main valve body, said supporting body including an internal flow channel having an inlet opening located upstream of said narrow passage at the end of a projection from said supporting body, said projection having a diameter smaller than the diameter of said narrow passage and an outlet opening at the downstream end of said supporting body selectively closeable by a valve, said projection further including a second slide guide for the upstream end of said main valve body; and a pressure chamber formed between the projection and the main valve body, said chamber connected by connecting channels to said internal flow channel.

2. The apparatus of claim 1, wherein said first and second slide guides include a hard coating.

3. The apparatus of claim 2, wherein said hard coating is comprised of tungsten carbide.

4. The apparatus of claim 1, wherein said internal flow channel inlet opening is formed by a plurality of laterally aligned boreholes on the upstream end of said projection.

5. The apparatus of claim 4, wherein a screen means is placed in front of said plurality of boreholes and said screen means is coaxially aligned and essentially flush with said projection.

6. The apparatus of claim 5, wherein said boreholes open into an annular space behind said screen means.

7. The apparatus of claim 1, wherein a safety stop for said main valve body is provided between the upstream end of said projection and the second slide guide.

8. The apparatus of claim 4, wherein a safety stop for said main valve body is provided between the upstream end of said projection and the second slide guide.

9. The apparatus of claim 8, wherein said safety stop associated with an attachment part at the upstream end of said projection.

10. The apparatus of claim 9, wherein said attachment part includes a coupling means for a pulling tool.

11. The apparatus of claim 9, wherein said internal flow channel extends into said attachment part, and said laterally aligned boreholes extend through said attachment part to communicate with said internal flow channel.

12. An apparatus for generating pressure pluses in a flow of drilling fluid through a wellbore, comprising:

a tubular casing for receiving said fluid flow and including a circumferential constriction on the interior thereof;

a supporting body coaxially mounted in said casing having a projection thereon extending through said casing constriction;

a selectively closeable internal flow channel within said supporting body extending into said projection having an inlet opening above said casing constriction and an outlet opening therebelow;

one or more connecting channels extending from said flow channel to the exterior of said supporting body between said inlet and outlet openings;

a substantially tubular main valve body longitudinally slidingly mounted on said support body adjacent said casing constriction, said support body and said main valve body defining a chamber therebetween in communication with said one or more connecting channels.

13. The apparatus of claim 12, wherein said main valve body slides on a first slide guide disposed on said projection, and a second slide guide disposed on said support body below said projection.

14. The apparatus of claim 13, further including valve body safety stop means associated with said projection, adopted to prevent said main valve body from moving beyond a predetermined distance from said constriction.

15. The apparatus of claim 12, wherein said internal flow channel is selectively closeable by an auxiliary valve disposed at the end of said support body opposite said projection.

* * * * *